US009953513B2

(12) United States Patent
Chua

(10) Patent No.: US 9,953,513 B2
(45) Date of Patent: Apr. 24, 2018

(54) OFFSHORE SECURITY MONITORING SYSTEM AND METHOD

(71) Applicant: Concorde Asia Pte. Ltd., Singapore (SG)

(72) Inventor: Swee Kheng Chua, Singapore (SG)

(73) Assignee: Concorde Asia Pte. Ltd., Singapore (SG)

( * ) Notice: Subject to any disclaimer, the term of this patent is extended or adjusted under 35 U.S.C. 154(b) by 0 days.

(21) Appl. No.: 15/508,802

(22) PCT Filed: Sep. 4, 2014

(86) PCT No.: PCT/SG2014/000417

§ 371 (c)(1),
(2) Date: Mar. 3, 2017

(87) PCT Pub. No.: WO2016/036312

PCT Pub. Date: Mar. 10, 2016

(65) Prior Publication Data

US 2017/0287314 A1 Oct. 5, 2017

(51) Int. Cl.

| | |
|---|---|
| ***G08B 1/08*** | (2006.01) |
| ***G08B 25/10*** | (2006.01) |
| *B63B 35/44* | (2006.01) |

(52) U.S. Cl.

CPC ..... *G08B 25/10* (2013.01); *B63B 35/44* (2013.01); *B63B 2035/4426* (2013.01)

(58) Field of Classification Search

CPC ..... G08B 25/10; G08B 19/00; G08B 25/14; B63B 2035/4426

USPC ..... 340/539.17, 541

See application file for complete search history.

(56) References Cited

U.S. PATENT DOCUMENTS

| | | | | |
|---|---|---|---|---|
| 7,397,361 | B2 * | 7/2008 | Paulsen | G08B 21/16 200/61.03 |
| 2004/0036596 | A1 * | 2/2004 | Heffner | G08B 13/19658 340/531 |
| 2009/0207020 | A1 | 8/2009 | Garnier et al. | |

FOREIGN PATENT DOCUMENTS

| | | | |
|---|---|---|---|
| EP | 2355451 | B1 | 1/2013 |
| WO | 2011092167 | A1 | 8/2011 |

OTHER PUBLICATIONS

International Search Report and Written Opinion for PCT/SG2014/000417, dated Oct. 9, 2014 (14 pages).

* cited by examiner

*Primary Examiner* — Toan N Pham
(74) *Attorney, Agent, or Firm* — Patent Law Works LLP

(57) ABSTRACT

A waterborne vessel includes a monitoring system configured to monitor the plurality of offshore properties such that the waterborne vessel is configured to respond to an alert signal transmitted from at least one of the plurality of offshore properties when the monitoring system receives the alert signal. An offshore security monitoring system includes the waterborne vessel and a base module deployed at each of the plurality of offshore properties. A security monitoring method may include monitoring the security of the plurality of offshore properties by the monitoring system of the waterborne vessel according to various embodiments, receiving an alert signal from the at least one of the plurality of offshore properties, and responding to the alert signal. A security monitoring unit includes, a plurality of waterborne vessels according to various embodiments, and a control center in communication with the plurality of waterborne vessels.

20 Claims, 2 Drawing Sheets

OFFSHORE SECURITY MONITORING SYSTEM AND METHOD

CROSS REFERENCE TO RELATED APPLICATIONS

This application is a National Stage of International Application No. PCT/SG2014/000417 filed Sep. 4, 2014, entitled "AN OFFSHORE SECURITY MONITORING SYSTEM AND METHOD", the entire contents of which are hereby incorporated by reference in its entirety.

TECHNICAL FIELD

The present invention relates to a waterborne vessel, a security monitoring unit, an offshore security monitoring system and a security monitoring method.

BACKGROUND

There has been increasing number of islands being developed around the world. For example, there are more getaway resorts or residences being built to cater to the increasing demand for such facilities. In addition, there are more island land being reclaimed to increase the land supply around popular destinations. Besides residential and leisure purposes, some important installations, e.g. refineries, are also being housed or constructed on islands for utilities and defense purposes.

These offshore properties, e.g. islands, ships, platforms, houses on stilts, have frequently been targets of criminal activities, e.g. looting, robbery, by aggressors like pirates. In addition, accidents, e.g. fire, may happen to the offshore properties.

Security of offshore properties have been challenging to maintain due to geographical barriers, e.g. water, between the mainland and the offshore properties. Essentially, the proximity between offshore properties and security outposts, e.g. police stations, fire stations, is much further than the distance between properties and the outpost on mainland. Therefore, the time required to reach offshore properties may be longer than that to reach a mainland property should an alarm be raised by the occupants of the offshore properties. Although government agencies may deploy security forces, e.g. coastal guards, to patrol the waterways for intruders, the security protection offered by the security forces may not be sufficient for privately owned offshore properties. These security forces are unable to provide sufficient security monitoring to each and every offshore properties given the size of the security forces versus the number of offshore properties and vast area of coverage. Consequently, the security of the offshore properties are more likely to be compromised. As such, it is the responsibility of owners or developers of the privately owned offshore properties to provide sufficient security protection.

In order to provide offshore properties the same level of security as that of the mainland properties, a substantial amount of resources has to be invested on the offshore properties. For example, in order for properties on an island to have a sizable security force, a substantial amount of resources, e.g. financial resources, have to be put in to hire the relevant manpower and built the necessary infrastructure. As such, the amount of resources required in achieving a sufficient level of security may be too onerous for some offshore property owners. Conversely, with limited resources, the offshore properties frequently lack sufficient security protection.

The present invention aims to improve the situation mentioned above.

SUMMARY

Accordingly to various embodiments, a waterborne vessel is provided. The waterborne vessel is configured to monitor the security of a plurality of offshore properties. The waterborne vessel includes a monitoring system configured to monitor the plurality of offshore properties such that the waterborne vessel is configured to respond to an alert signal transmitted from at least one of the plurality of offshore properties when the monitoring system receives the alert signal.

According to various embodiments, the monitoring system may be configured to monitor the security of the plurality of offshore properties simultaneously.

According to various embodiments, the waterborne vessel may be configured to respond to the alert signal by moving the waterborne vessel to the at least one of the offshore properties when the alert signal is received by the waterborne vessel.

According to various embodiments, the waterborne vessel further includes an automatic identification system (AIS) configured to identify the location of the waterborne vessel.

According to various embodiments, the waterborne vessel may communicate with the plurality of offshore properties via Super-WiFi.

According to various embodiments, the waterborne vessel may be configured to patrol around at least one of the plurality of offshore properties.

According to various embodiments, an offshore security monitoring system configured to monitor the security of a plurality of offshore properties is provided. The offshore security monitoring system includes a waterborne vessel according to previous embodiments and a base module deployed at each of the plurality of offshore properties. The base module being configured to communicate with the monitoring system on the waterborne vessel, such that the base module may be configured to transmit the alert signal when activated.

According to various embodiments, the base module may include at least one of a fire detection module, a motion detection module or a hazardous gas detection module.

According to various embodiments, the base module may be operable by an operator.

According to various embodiments, the base module may communicate with the waterborne vessel via Super-WiFi.

According to various embodiments, the base module may be portable.

According to various embodiments, the offshore security monitoring system may further include a remote surveillance system configured to communicate with the waterborne vessel. The remote surveillance system may be configured to monitor at least one of the plurality of offshore properties.

According to various embodiments, the remote surveillance system may be remotely controlled by the waterborne vessel.

According to various embodiments, the remote surveillance system may be configured to monitor the at least one of the plurality of offshore properties only when the alert signal is received by the monitoring system of the waterborne vessel.

According to various embodiments, the remote surveillance system may include a close circuit camera configured to survey the property.

According to various embodiments, the close circuit camera may be operable upon receipt of the alert signal from the base module at the at least one of the offshore properties.

According to various embodiments, the remote surveillance system may include an aerial surveillance vehicle.

According to various embodiments, the aerial surveillance vehicle may include an unmanned aircraft.

According to various embodiments, the remote surveillance system may communicate with the waterborne vessel via Super-WiFi.

According to various embodiments, the waterborne vessel may be configured to respond to the alert signal by moving the waterborne vessel to the at least one of the offshore properties when the alert signal is received by monitoring system the waterborne vessel.

According to various embodiments, a security monitoring method for monitoring the security of a plurality of offshore properties is provided. The security monitoring method may include monitoring the security of the plurality of offshore properties by the monitoring system of the waterborne vessel according to various embodiments, receiving an alert signal from the at least one of the plurality of offshore properties, and responding to the alert signal.

According to various embodiments, the plurality of offshore properties may be monitored simultaneously.

According to various embodiments, responding to the alert signal may include moving the waterborne vessel to the at least one of the offshore properties when the alert signal is received by the waterborne vessel.

According to various embodiments, the security monitoring method may further include transmitting the alert signal from the base module to the waterborne vessel.

According to various embodiments, responding to the alert signal may include surveying the at least one of the plurality of offshore properties by a remote surveillance system when the alert signal is received by the waterborne vessel.

According to various embodiments, the security monitoring method may further include controlling the remote surveillance system remotely by the waterborne vessel.

According to various embodiments, the security monitoring method may further include patrolling at least one of the plurality of offshore properties.

According to various embodiments, a security monitoring unit configured to monitor the security of a plurality of offshore properties is provided. The security monitoring unit includes, a plurality of waterborne vessels according to various embodiments, and a control centre in communication with the plurality of waterborne vessels.

According to various embodiments, the control centre may be a waterborne vessel.

According to various embodiments, the communication between the control centre and the plurality of waterborne vessels may be via Super-WiFi.

According to various embodiments, the communication between the plurality of waterborne vessels may be via Super-WiFi.

The present invention aims to provide better security protection to the plurality of offshore properties without substantial cost and resources as mentioned above. In a way, the present invention pools the resources for security protection of the plurality of offshore properties and yet provide relatively fast and efficient response to any security breach.

DETAILED DESCRIPTION

Figure 1:
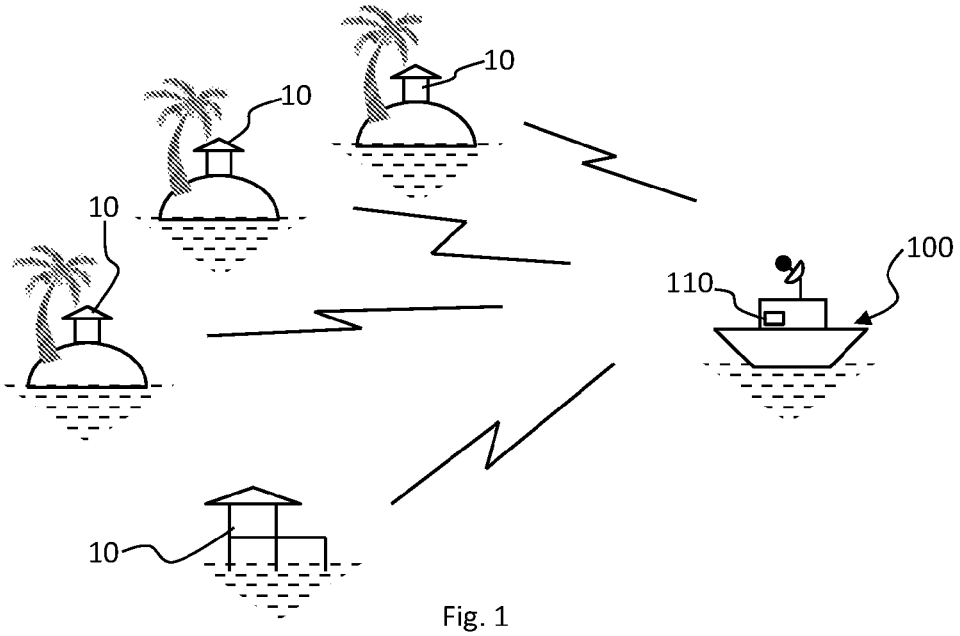
FIG. 1 shows an exemplary waterborne vessel configured to monitor the security of a plurality of offshore properties.

FIG. 1 shows an exemplary waterborne vessel 100 configured to monitor the security of a plurality of offshore properties 10. Waterborne vessel 100 includes a monitoring system 110 configured to monitor the plurality of offshore properties 10, such that the waterborne vessel 100 is configured to respond to an alert signal transmitted from at least one of the plurality of offshore properties 10 when the monitoring system 110 receives the alert signal.

As shown in FIG. 1, the waterborne vessel 100 may include a monitoring system 110 configured to monitor the security of the plurality of offshore properties 10. One or more of the plurality of offshore properties 10 may transmit an alert signal, for example, when security is breached.

Waterborne vessel 100 may be a ship, a motorized boat, a self-propelled floating platform with a control room. Waterborne vessel 100 may be a high speed boat. Waterborne vessel 100 may carry at least one of the following functional teams: a security team, a maintenance team, an emergency response team, a medical team, etc.

Monitoring system 110 may monitor the alert signals from the plurality of offshore properties 10. At least one of the plurality of offshore properties 10 may transmit an alert signal when security is breached. Security of the plurality of offshore properties 10 may include physical security whereby breach of physical security may include trespassing of the offshore property 10. Security of the plurality of offshore properties 10 may also include hazard security whereby breach of security may include an explosion, fire at an offshore property 10. Security is breached when there is an unauthorized or unanticipated activity or event that occurred at an offshore property. For example, an intruder into the offshore property, a fire breakout or a power failure at the offshore property. When security is breached, the safety of the people within the offshore property or the offshore property may be compromised. When the monitoring system 110 receives the alert signal, the waterborne vessel 100 may respond to the alert signal.

Monitoring system 110 may be configured to monitor the security of the plurality of offshore properties 10 simultaneously. Monitoring system 110 may monitor the plurality of offshore properties 10 within its surveillance perimeter concurrently.

Waterborne vessel 100 may communicate with the plurality of offshore properties 10 via Super-WiFi. Waterborne vessel 100 may communicate with the plurality of offshore properties 10 via radiowave. Waterborne vessel 100 may communicate with the plurality of offshore properties 10 within the radio spectrum of TV White Spaces (TVWS), e.g. at a frequency between 450-700 MHz.

Monitoring system 110 may include a radiowave receiving module configured to receive the alert signal. Monitoring system 110 may include at least one of a close circuit monitoring system, a card access monitoring system 110 and/or a motion sensor monitoring system 110. Waterborne vessel 100 may include systems to support the monitoring system 110, e.g. control panels, communication system, display monitors, servers, routers, modems, signal encryption devices, modems, DV recorders, decoding module, etc.

Upon receipt of the monitoring system 110, the waterborne vessel 100 may respond to the alert signal accordingly.

Waterborne vessel 100 may be configured to respond to the alert signal by moving the waterborne vessel 100 to the at least one of the offshore properties 10 when the alert signal is received by the waterborne vessel 100. Upon receipt of the alert signal, the waterborne vessel 100 may approach the at least one of the offshore properties 10. Waterborne vessel 100 may investigate the at least one of the offshore properties 10 for the cause for transmitting the alert signal. Upon reaching at least one of the offshore properties 10, personnel on the waterborne vessel 100 may alight from the waterborne vessel 100 to board or enter the at least one of the offshore properties to investigate the cause for the alert signal.

Figure 2:
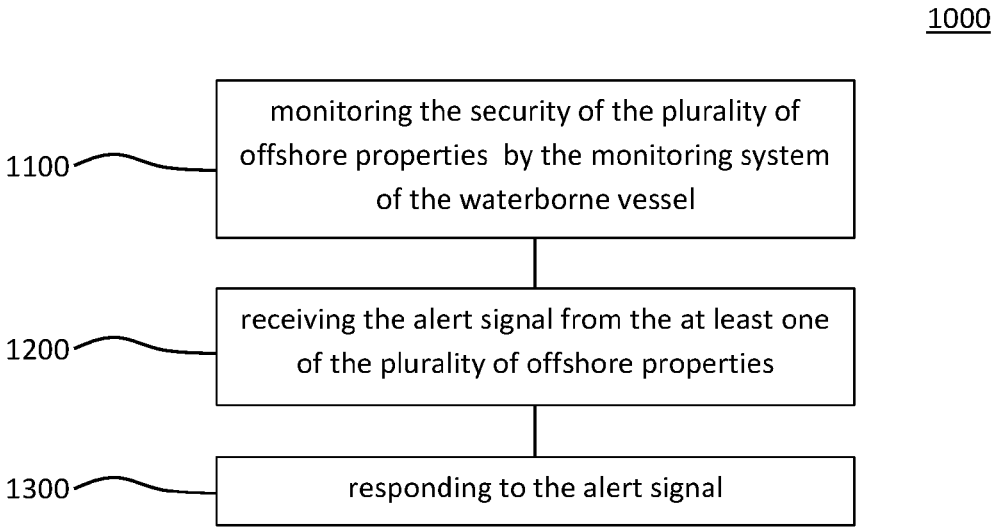
FIG. 2 shows an exemplary security monitoring method for the plurality of offshore properties using the waterborne vessel as shown in FIG. 1.

FIG. 2 shows a security monitoring method 1000 for monitoring the security of a plurality of offshore properties 10. Security monitoring method 1000 includes monitoring the security of the plurality of offshore properties 10 by the monitoring system 110 of the waterborne vessel 100 in 1100, receiving the alert signal from the at least one of the plurality of offshore properties 10 in 1200, and responding to the alert signal in 1300.

Waterborne vessel 100 may monitor the plurality of offshore properties 10 visually. For example, the waterborne vessel 100 may monitor the plurality of offshore properties 10 for visual alert signals, e.g. flares that are shot from flare guns, from at least one of the plurality of offshore properties 10. Upon sighting the visual alert signals, the waterborne vessel 100 may respond to the visual alert signals as mentioned above. In this example, the base module 210 may include a device for activating a visual alert signal.

Figure 3:
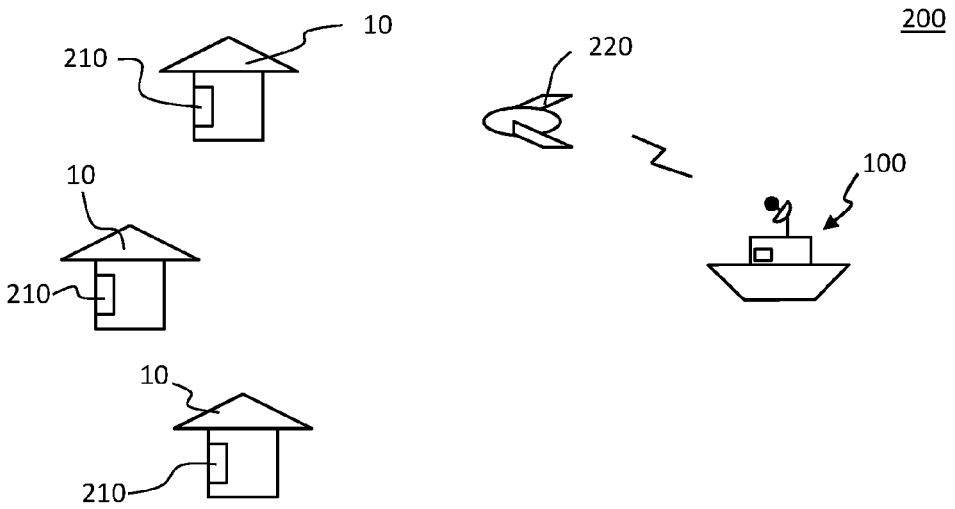
FIG. 3 shows an exemplary offshore security monitoring system.

FIG. 3 shows an exemplary an offshore security monitoring system 200. Offshore monitoring system 200 is configured to monitor the security of the plurality of offshore properties 10. Offshore security monitoring system 200 includes the waterborne vessel 100 and a base module 210 deployed at each of the plurality of offshore properties 10. Base module 210 is configured to communicate with the monitoring system 110 on the waterborne vessel 100, such that the base module 210 is configured to transmit the alert signal to the waterborne vessel 100 when activated.

Offshore security monitoring system 200 may be configured to monitor the plurality of offshore properties 10. Based module 210 may be installed in each of the plurality of offshore properties 10. Base module 210 may be a security module configured to detect and/or deter any security breach. Base module 210 may include a user interface configured to interact with an occupant. Base module 210 may be configured to receive instruction from the occupant and/or detect security breaches within and/or around the plurality of offshore properties 10. Base module 210 may be in communication with the monitoring system 110 of the waterborne vessel 100. Base module 210 may be activated to transmit the alert signal which may be received by the monitoring system 110. Base module 210 may be operable by an operator. Operator may be a occupant in the offshore property 10. When the person detects a breach in security, e.g. intruder, fire, the operator may operate the base module 210 by activating the base module 210, e.g. hitting a help button, to transmit the alert signal. Base module 210 may be used to detect security breaches. Base module 210 may include at least one of a fire detection module configured to detect fire, a motion detection module configured to detect motion within the offshore property 10 or a hazardous gas detection module configured to detect hazardous gas within the offshore property 10 or a shock module configured to detect impact, e.g. due to explosion. Base module 210 may include a building facility monitoring module configured to monitor the facilities in each of the plurality of offshore properties 10. Building facility monitoring module may be configured to communicate with any building facilities detection system, e.g. fire detection system, such that the base module 210 may be configured to transmit an alert signal to the waterborne vessel 100 in the event of a security breach, e.g. fire. Base module 210 may include a close circuit camera configured to survey the offshore property 10. Close circuit camera may be deployed outside and/or inside the offshore property 10. Close circuit camera may be operable upon receipt of the alert signal. Base module 210 may be configured to automatically transmit the alert signal to the waterborne vessel 100 when a security breach is detected. Base module 210 may include a transmitter configured to transmit the alert signal. Base module 210 may communicate with the monitoring system 110 via Super-Wife. Transmitter may be configured to transmit signals in radio spectrum in TV White Spaces (TVWS). Transmitter may be configured to transmit signals at a frequency between 450-700 MHz. Base module 210 may be portable or detachably installed to each of the plurality of offshore properties 10. Base module 210 may be placed within each of the plurality of offshore properties 10 without a permanent installation so that it is convenient to deploy the base module 210 to each of the plurality of offshore properties 10 and the location of the base module 210 within or around each of the plurality of offshore properties 10 is flexible.

As shown in FIG. 3, the offshore security monitoring system 200 may include a remote surveillance system 220. Remote surveillance system 220 may be configured to monitor at least one of the plurality of offshore properties 10. Remote surveillance system 220 may be configured to survey the plurality of offshore properties 10. Remote surveillance system 220 may be deployed from and/or controlled by the waterborne vessel 100. Waterborne vessel 100 may respond to the alert signal by activating the remote surveillance system 220. Remote surveillance system 220 may be deployed quickly and used to provide a first surveillance before the waterborne vessel 100 advances to the plurality of offshore properties 10. Remote surveillance system 220 may be configured to survey around and/or within each of the plurality of offshore properties 10. Surveying and monitoring of the plurality of offshore properties 10 may include capturing a video footage or a photograph of the each of the plurality of offshore properties 10 from above and/or within the plurality of offshore properties 10. Remote surveillance system 220 may include wide angled camera to capture a wide area around each of the plurality of offshore properties 10. Remote surveillance system 220 may include a thermal scanner to scan for heat emitting bodies, for example, to determine the location and number of people in each of the plurality of offshore properties 10. Remote surveillance system 220 may be configured to transmit signals, e.g. image signal, back to waterborne vessel 100. In this way, the functional teams may be able to receive live intelligence/updates of the situation of the plurality of offshore properties 10. Functional teams may use this information to assess and determine the course of action required and respond accordingly. For example, the functional team may be able to determine if the alert signal is a false alarm.

Remote surveillance system 220 may be configured to communicate with the waterborne vessel 100. Remote surveillance system 220 may be remotely controlled by the waterborne vessel 100. Waterborne vessel 100 may include a transmitter to transmit control signals to the remote surveillance system 220. Remote surveillance system 220 may include a receiver for receiving control signals from the waterborne vessel 100 to control the operation of the remote surveillance system 220. Remote surveillance system 220 may communicate with the waterborne vessel 100 via radio wave. Remote surveillance system 220 may communicate with the waterborne vessel 100 via Super-WiFi. Remote surveillance system 220 may communicate with the Waterborne vessel 100 within the radio spectrum of TV White Spaces (TVWS), e.g. at a frequency between 450-700 MHz.

Remote surveillance system 220 may be configured to monitor the at least one of the plurality of offshore properties 10 only when the alert signal is received by the monitoring system 110 of the waterborne vessel 100. Remote surveillance system 220 may be configured to hover around the plurality of offshore properties 10 but without monitoring the plurality of offshore properties 10. This may be useful if privacy is required for at least one of the plurality of offshore properties 10. Remote surveillance system 220 may be configured to commence monitoring, e.g. video capturing, of the at least one of the plurality of offshore properties 10 when an alert signal is received by the waterborne vessel 100, whereby the waterborne vessel 100 may transmit a signal to the remote surveillance system 220 to commence on the monitoring of the at least one of the plurality of offshore properties 10. For example, the remote surveillance system 220 may be hovering above at least one of the plurality of offshore properties 10 without monitoring activation. When an alert signal is received by the waterborne vessel 100 from an offshore property 10, the waterborne vessel 100 may activate the remote surveillance system 220 to commence activation of the offshore property 10. In another example, the remote surveillance system 220 may be deployed within or around the offshore property 10 without being activated to monitor the offshore property 10. When an alert signal is received from the offshore property 10, the waterborne vessel 100 may activate the remote surveillance system 220 to commence monitoring of the offshore property 10. Remote surveillance system 220 may include a close circuit camera configured to survey the offshore property 10.

Remote surveillance system 220 may include an aerial surveillance vehicle. Aerial surveillance vehicle may be an unmanned aircraft, e.g. glider, helicopter.

In addition or concurrently, the waterborne vessel 100 may be configured to respond to the alert signal by moving the waterborne vessel 100 to the at least one of the offshore properties 10 when the alert signal is received by monitoring system 110 the waterborne vessel 100. As mentioned, upon receipt of the alert signal, the waterborne vessel 100 may approach the at least one of the offshore properties 10. Remote surveillance system 220 may provide an initial intelligence or feedback of the situation of the at least one of the offshore properties 10. Waterborne vessel 100 may follow to investigate the at least one of the offshore properties 10 for the cause for transmitting the alert signal and/or for more details of the security breach and/or provide assistance to the occupant of the at least one of the offshore properties 10.

As mentioned earlier, the plurality of offshore properties 10 are monitored simultaneously. To alert the waterborne vessel 100, the alert signal may be transmitted from the base module 210 to the waterborne vessel 100. To respond to the alert signal, the waterborne vessel 100 may move to the at least one of the offshore properties 10 when the alert signal is received by the waterborne vessel 100. By responding to the alert signal, the remote surveillance system 220 may survey the at least one of the plurality of offshore properties 10 when the alert signal is received by the waterborne vessel 100. Remote surveillance system 220 may be controlled remotely by the waterborne vessel 100.

Waterborne vessel 100 may be configured to patrol around at least one of the plurality of offshore properties 10. Waterborne vessel 100 may be anchored at a location to monitor the plurality of offshore properties 10. Waterborne vessel 100 may patrol around the plurality of offshore properties 10 to provide perimeter surveillance around the plurality of offshore properties 10.

Figure 4:
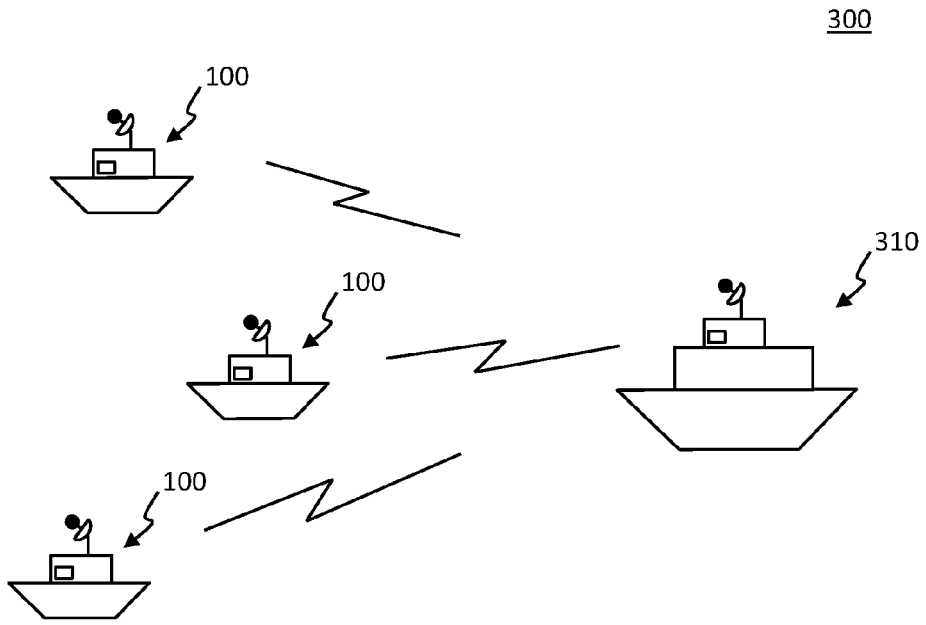
FIG. 4 shows an exemplary security monitoring unit.

FIG. 4 shows an exemplary security monitoring unit 300 configured to monitor the security of a plurality of offshore properties 10. Security monitoring unit 300 includes a plurality of waterborne vessels 100 and a control centre 310 in communication with the plurality of waterborne vessels 100.

When there is a need for a plurality of waterborne vessels 100 to be deployed, a control centre 310 may be established to coordinate the operation between the plurality of waterborne vessels 100. Control centre 310 may be in communication with the plurality of waterborne vessels 100. Waterborne vessel 100 may include an automatic identification system (AIS) configured to identify the location of the waterborne vessel 100. As the waterborne vessels 100 may be equipped with AIS technology, the control centre 310 may be able to locate the location of the waterborne vessels 100 at any point in time. As shown in FIG. 4, the control centre 310 may be a waterborne vessel 100. Control centre 310 may also be a control centre on the mainland. Control centre 310 may be a command post located on the mainland to coordinate the operations of the waterborne vessels 100. Control centre 310 may communicate with the plurality of waterborne vessels 100 via radio wave. Control centre 310 may communicate with the plurality of waterborne vessels 100 via Super-WiFi. Control centre 310 may communicate with the plurality of waterborne vessels 100 within the radio spectrum of TV White Spaces (TVWS), e.g. at a frequency between 450-700 MHz. Communication between the plurality of waterborne vessels 100 may be via Super-WiFi. Communication between the plurality of waterborne vessels 100 may be within the radio spectrum of TV White Spaces (TVWS), e.g. at a frequency between 450-700 MHz.

The functional teams on the waterborne vessels 100 may be a first line of contact with the offshore property 10 to attend to relatively small security breaches, events or incidents. If the security breaches, events or incidents are beyond the capabilities of the functional teams, or if the functional teams are not able to attend to the security breaches, events or incidents, mainland assistance may be sought to attend to the security breach. As such, the waterborne vessel 100 may be in communication with the mainland assistance, e.g. coastal guards, medical personnel. By having the waterborne vessel 100 monitor the plurality of offshore properties 10, the reaction time required to activate the mainland assistance may be shorter as the personnel on the waterborne vessel 100 may have direct communication with the mainland assistance. Functional teams may be trained to identify and handle security breaches. In this way, a security breach may be more appropriately handled and the chances of lives and/or properties being saved may be higher.

The invention claimed is:

1. An offshore security monitoring system configured to respond to an alert signal transmitted from at least one of a plurality offshore properties, the offshore security monitoring system comprising, a waterborne vessel comprising a monitoring system configured to monitor the alert signal; and a base module deployed at each of the plurality of offshore properties, the base module configured to communicate with the monitoring system on the waterborne vessel, wherein the base module is configured to detect a security breach in at least one of the each of the plurality of offshore properties and transmit the alert signal when security of at least one of the each of the plurality of offshore properties is breached;

wherein the waterborne vessel is configured to respond to the alert signal when the monitoring system receive the alert signal.

2. The offshore security monitoring system of claim 1, wherein the monitoring system is configured to monitor the security of the plurality of offshore properties simultaneously.

3. The offshore security monitoring system of claim 1, wherein the waterborne vessel is configured to respond to the alert signal by moving the waterborne vessel to the at least one of the offshore properties when the alert signal is received by the waterborne vessel.

4. The offshore security monitoring system of claim 1, wherein the waterborne vessel further comprises an automatic identification system (AIS) configured to identify a location of the waterborne vessel.

5. The offshore security monitoring system of claim 1, wherein the base module includes at least one of a fire detection module, a motion detection module or a hazardous gas detection module.

6. The offshore security monitoring system of claim 1, wherein the base module communicates with the waterborne vessel via Super-WiFi.

7. The offshore security monitoring system of claim 1, further comprising a remote surveillance system configured to communicate with the waterborne vessel, the remote surveillance system configured to monitor at least one of the plurality of offshore properties.

8. The offshore security monitoring system of claim 7, wherein the remote surveillance system is remotely controlled by the waterborne vessel.

9. The offshore security monitoring system of claim 7, wherein the remote surveillance system is configured to monitor the at least one of the plurality of offshore properties only when the alert signal is received by the monitoring system of the waterborne vessel.

10. The offshore security monitoring system of claim 7, wherein the remote surveillance system comprises a close circuit camera configured to survey the offshore property.

11. The offshore security monitoring system of claim 10, wherein the close circuit camera is operable upon receipt of the alert signal from the base module at the at least one of the offshore properties.

12. The offshore security monitoring system of claim 7, wherein the remote surveillance system comprises an aerial surveillance vehicle.

13. The offshore security monitoring system of claim 12, wherein the aerial surveillance vehicle comprises an unmanned aircraft.

14. The offshore security monitoring system of claim 7, wherein the remote surveillance system communicates with the waterborne vessel via Super-WiFi.

15. The offshore security monitoring system of claim 1, wherein the base module comprises a building facility monitoring module configured to monitor facilities in each of the plurality of offshore properties, wherein the alert signal is transmitted to the waterborne vessel when security of at least one of the plurality of offshore properties is breached.

16. A security monitoring method for responding to an alert signal transmitted from at least one of a plurality offshore properties by an offshore security monitoring system of claim 1, the security monitoring method comprising, monitoring the alert signal from at least one of the plurality of offshore properties by the monitoring system of the waterborne vessel;

communicating with the monitoring system on the waterborne vessel by the base module deployed at each of the plurality of offshore properties;

detecting a security breach in at least one of the each of the plurality of offshore properties by the base module;

transmitting the alert signal from the base module when security of at least one of the each of the plurality of offshore properties is breached;

receiving an alert signal from each of the plurality of offshore properties by the monitoring system; and responding to the alert signal.

17. The security monitoring method of claim 16, wherein the plurality of offshore properties are monitored simultaneously.

18. The security monitoring method of claim 16, wherein responding to the alert signal comprises moving the waterborne vessel to the at least one of the offshore properties when the alert signal is received by the waterborne vessel.

19. The security monitoring method of claim 16, wherein responding to the alert signal comprises surveying the at least one of the plurality of offshore properties by a remote surveillance system when the alert signal is received by the waterborne vessel.

20. The security monitoring method of claim 16, further comprising controlling a remote surveillance system remotely by the waterborne vessel.

* * * * *